US010031475B2

(12) United States Patent
Okamoto et al.

(10) Patent No.: US 10,031,475 B2
(45) Date of Patent: Jul. 24, 2018

(54) IMAGE FORMATION APPARATUS

(71) Applicant: Konica Minolta, Inc., Chiyoda-ku, Tokyo (JP)

(72) Inventors: Akira Okamoto, Hino (JP); Keigo Ogura, Tokyo (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/598,425

(22) Filed: May 18, 2017

(65) Prior Publication Data

US 2017/0336756 A1 Nov. 23, 2017

(30) Foreign Application Priority Data

May 20, 2016 (JP) ..... 2016/101090

(51) Int. Cl.
*G03G 21/20* (2006.01)
*G03G 15/16* (2006.01)
*G03G 15/01* (2006.01)

(52) U.S. Cl.
CPC ..... *G03G 21/203* (2013.01); *G03G 15/161* (2013.01); *G03G 15/0189* (2013.01)

(58) Field of Classification Search
CPC .. G03G 21/20; G03G 21/203; G03G 15/0189; G03G 2215/00776; G03G 2215/0122–2215/0135; G03G 2215/1623; G03G 15/161
See application file for complete search history.

(56) References Cited

U.S. PATENT DOCUMENTS 5,623,330 A * 4/1997 Ishibashi ..... G03G 15/1685 399/310
5,966,564 A * 10/1999 Kizaki ..... G03G 15/168 399/101
2012/0224879 A1* 9/2012 Fujita ..... G03G 15/0189 399/94
2012/0321357 A1* 12/2012 Ogiyama ..... G03G 15/0194 399/308

(Continued)

FOREIGN PATENT DOCUMENTS

JP 2009-288416 A 12/2009

OTHER PUBLICATIONS

Yamamoto et al. "Electrographic Color Printer Engine." Aug. 1998, OKI Technical Review, vol. 64.*

*Primary Examiner* — Carla Therrien
(74) *Attorney, Agent, or Firm* — Buchanan Ingersoll & Rooney PC

(57) ABSTRACT

An image formation apparatus having a recording medium held between a photosensitive drum and a transfer belt and transferring a toner image from the photosensitive drum to the recording medium includes: a first heating unit to which power is supplied directly from outside when power of the apparatus is off; a second heating unit used in heating control when the power of the apparatus is on; a humidity detection unit configured to detect humidity inside the apparatus; and a control unit configured to, when the power of the apparatus is on, heat the transfer belt by controlling the first heating unit and the second heating unit on the basis of output of the humidity detection unit, wherein the transfer belt is heated by the first heating unit when the power of the apparatus is off.

12 Claims, 7 Drawing Sheets

(56) References Cited

U.S. PATENT DOCUMENTS

2015/0110508 A1* 4/2015 Nishi ..... G03G 21/203
399/44
2017/0068203 A1* 3/2017 Kinoshita ..... G03G 15/80

* cited by examiner

IMAGE FORMATION APPARATUS

The entire disclosure of Japanese Patent Application No. 2016-101090 filed on May 20, 2016 including description, claims, drawings, and abstract are incorporated herein by reference in its entirety.

BACKGROUND OF THE INVENTION

Field of the Invention

The present invention relates to an image formation apparatus.

Description of the Related Art

There have been image formation apparatuses which transfer a toner image on a photosensitive drum to a recording medium such as a sheet with the use of a transfer belt to which voltage is applied. If the inside of the apparatus is under a high-temperature high-humidity environment during the image formation, the transfer belt absorbs the moisture in the environment. Such moisture absorption causes the transfer belt to have lower resistance, resulting in a smaller potential difference between the recording medium and the transfer belt. Therefore, the adsorbing power of the transfer belt to adsorb the recording medium is lower than that of the photosensitive drum to adsorb the recording medium. This makes it difficult for the recording medium to separate from the photosensitive drum. As a result, problems occur that, for example, the recording medium is wound around the photosensitive drum and the environment inside the image formation apparatus may deteriorate the image quality.

In view of this, JP 2009-288416 A has disclosed the image formation apparatus that calculates the resistance value from the current value of the intermediate transfer belt. In this apparatus, if the calculated resistance value is less than or equal to the threshold, the intermediate transfer belt is heated by the heater, so that the internal environment of the image formation apparatus is made suitable for the image formation. Thus, the image quality is maintained to be high.

However, the image formation apparatus according to JP 2009-288416 A is to control the humidity when the image is formed, i.e., when the power is supplied. This apparatus is not made in consideration of the image formation when the power is supplied after the power-off state is continued for a long time in the state that the inside of the image formation apparatus is under the high-temperature high-humidity environment.

Even if the heating by the heater is started after the power is supplied in this state, it requires long time to remove the moisture contained in the transfer belt, which has been exposed to the high-temperature and high-humidity state for a long time. Thus, the warm-up time is long (for example, about 1 to 2 hours) and the start of the image formation is delayed.

SUMMARY OF THE INVENTION

An object of the present invention is to provide an image formation apparatus that can start the image formation in a short time after the power supply, even though the power-off state has continued for a long time.

To achieve the abovementioned object, according to an aspect, an image formation apparatus having a recording medium held between a photosensitive drum and a transfer belt and transferring a toner image from the photosensitive drum to the recording medium, reflecting one aspect of the present invention comprises:

a first heating unit to which power is supplied directly from outside when power of the apparatus is off;

a second heating unit used in heating control when the power of the apparatus is on;

a humidity detection unit configured to detect humidity inside the apparatus; and a control unit configured to, when the power of the apparatus is on, heat the transfer belt by controlling the first heating unit and the second heating unit on the basis of output of the humidity detection unit, wherein the transfer belt is heated by the first heating unit when the power of the apparatus is off.

According to an invention of Item. 2, in the image formation apparatus of Item. 1, the transfer belt is preferably housed in a conveyance unit, and the first heating unit is preferably provided outside the conveyance unit and the second heating unit is preferably provided inside the conveyance unit.

According to an invention of Item. 3, in the image formation apparatus of Item. 1 or 2, the control unit preferably terminates heating of the transfer belt when the humidity in the apparatus becomes lower than target humidity.

According to an invention of Item. 4, in the image formation apparatus of Item. 3, the control unit preferably terminates heating of the transfer belt when the humidity in the apparatus becomes lower than the target humidity and a predetermined time has passed after the humidity in the apparatus becomes lower than the target humidity.

According to an invention of Item. 5, in the image formation apparatus of Item. 3 or 4, the control unit preferably heats the transfer belt by controlling the first heating unit and the second heating unit when the humidity in the apparatus is higher than second target humidity, which is higher than the target humidity, and the control unit preferably heats the transfer belt by controlling the second heating unit when the humidity in the apparatus is lower than second target humidity and higher than the target humidity.

According to an invention of Item. 6, in the image formation apparatus of any one of Items. 1 to 5, the image formation apparatus preferably further comprises a driving unit configured to rotate the transfer belt, wherein the control unit preferably controls the driving unit to rotate the transfer belt when the transfer belt is heated.

According to an invention of Item. 7, in the image formation apparatus of any one of Items. 1 to 6, the control unit preferably controls a rotation speed of the transfer belt on the basis of the output of the humidity detection unit.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

Embodiment

[1. Description of Structure]

Figure 1:
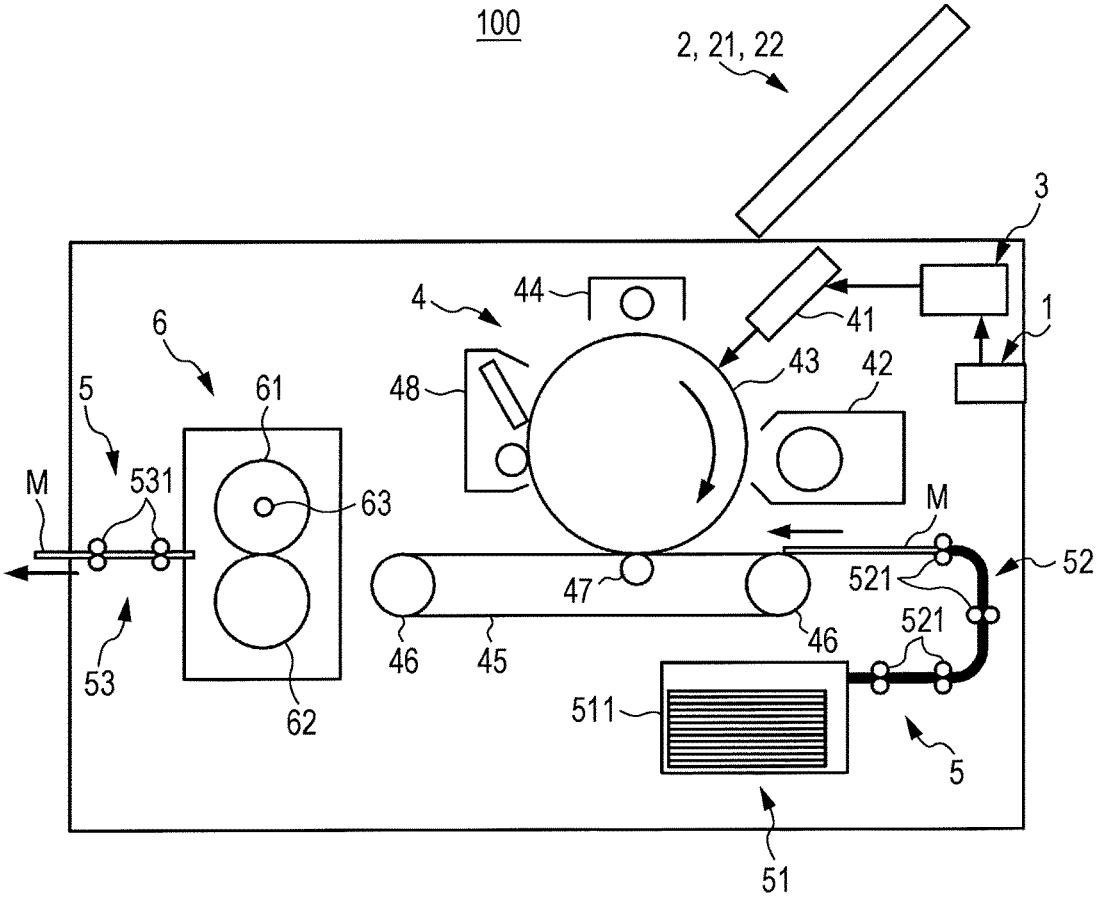
FIG. 1 is a diagram illustrating a schematic structure of an image formation apparatus according to an embodiment of the present invention.
Figure 2:
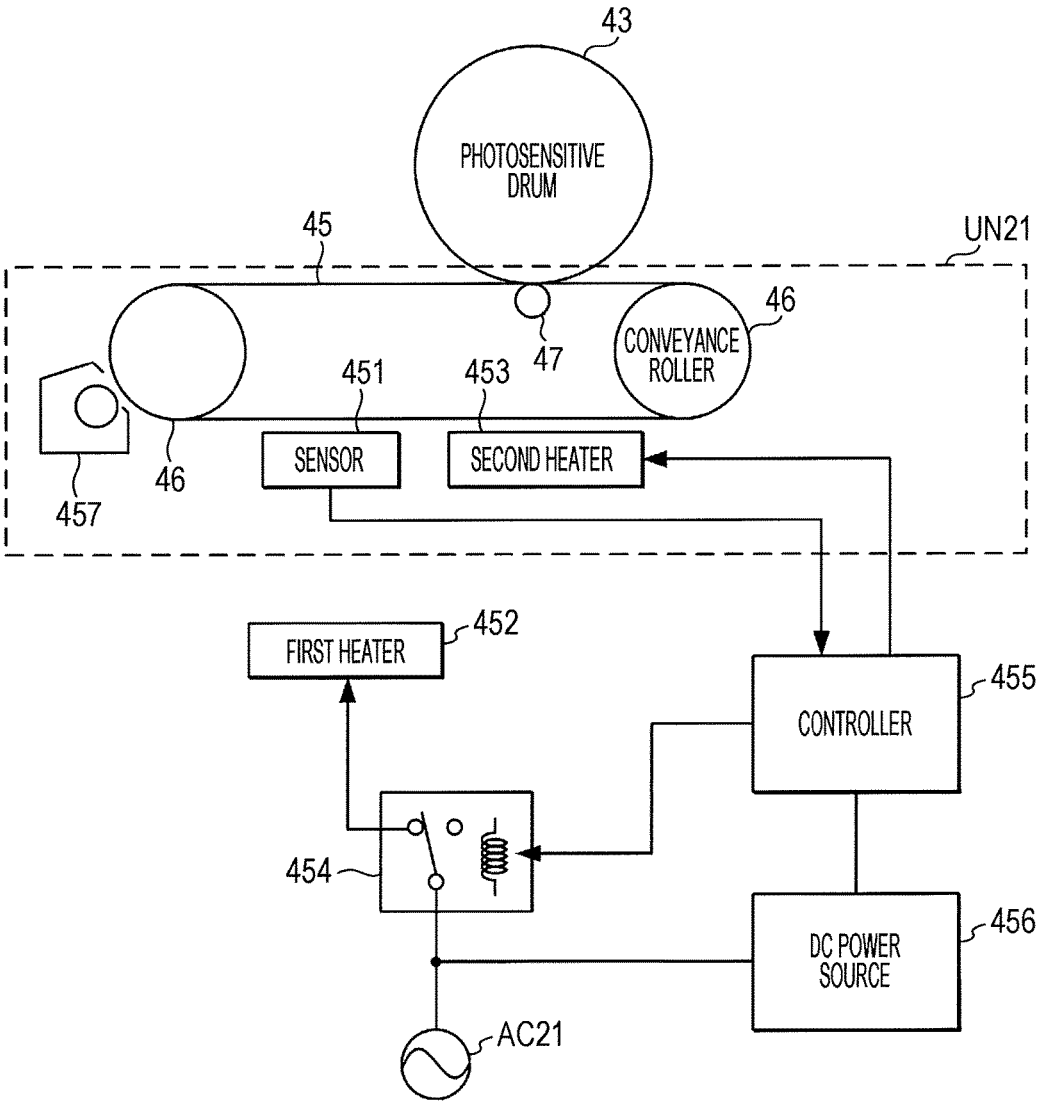
FIG. 2 is a schematic diagram in which a transfer belt part of an image formation portion is magnified, and a control circuit diagram.

FIG. 1 illustrates a schematic structure of an image formation apparatus 100 according to an embodiment of the present invention. FIG. 2 is a schematic diagram in which a transfer belt part of an image formation portion is magnified, and a control circuit diagram.

In the embodiment, the plug of the image formation apparatus 100 is inserted to an outlet of an AC power source (commercial power source), so that the image formation apparatus 100 is operated/non-operated by turning ON/OFF the main switch of the image formation apparatus 100.

As illustrated in FIG. 1, the image formation apparatus 100 forms an image on a sheet (recording medium) M on the basis of, for example, image data input from an external information device (such as a personal computer) through a network.

Here, the image data include not just data of images such as diagrams and photographs but also the text data such as letters and symbols.

The image formation apparatus 100 is the direct-transfer type image formation apparatus in which a toner image is directly transferred from a photosensitive drum as the image carrier to the recording medium.

Specifically, the image formation apparatus 100 includes an image acquiring portion 1, an operation display portion 2, an image processing portion 3, an image formation portion 4, a conveyance portion 5, a fixing device 6, a controller 455 (described below), and the like.

The image acquiring portion 1 includes a communication device that acquires image data by communicating with an external information device through a network, an input device that acquires image data from a storage medium such as a USB (Universal Serial Bus) memory inserted into an input port, or the like.

Alternatively, the image acquiring portion 1 may acquire the image data by reading the image on the document with a document image scanning device (scanner) or the like, which is not shown.

The operation display portion 2 includes a liquid crystal display (LCD) provided with a touch panel, for example, and functions as a display portion 21 and an operation portion 22.

The display portion 21 displays various operation screens, the image state, the operation status of each function, and the like in accordance with display control signals input from the controller.

The operation portion 22 includes various operation keys including numeric keys and a start key; upon the acceptance of user's various input operation, the operation portion 22 outputs the operation signal to the controller.

The image processing portion 3 generates the digital image data on the basis of the image data input from the outside. The image processing portion 3 performs a gradation reproducing process (such as a screening process), a correcting process (such as a shading correction) in accordance with the initial setting or the user's setting, a compression process, and the like on the digital image data. Based on the digital image data on which these processes have been performed, the image formation portion 4 is controlled.

The image formation portion 4 includes an exposure device 41, a development device 42, a photosensitive drum 43, a charging device 44, a transfer belt 45, a conveyance roller 46, a transfer roller 47, a cleaning device 48, and the like.

In the image formation portion 4, the charging device 44 charges the photosensitive drum 43. The exposure device 41 includes, for example, a semiconductor laser and irradiates the photosensitive drum 43 with a laser beam corresponding to the toner image. This forms an electrostatic latent image on a surface of the photosensitive drum 43. The development device 42 contains a developer (for example, two-component developer formed of small-diameter toner and a magnetic material), and develops the electrostatic latent image by attaching the toner on the surface of the photosensitive drum 43 (the formation of a toner image).

The transfer belt 45 is stretched between two conveyance rollers 46. The transfer roller 47 is disposed opposite to the photosensitive drum 43, and has the transfer belt 45 held between the transfer roller 47 and the photosensitive drum 43. The transfer belt 45 conveys the sheet M on a surface thereof opposite to the photosensitive drum 43, and has the sheet M in pressure contact with the photosensitive drum 43. Thus, the toner image is transferred to the sheet M.

The toner remaining on the photosensitive drum after the transfer is removed by a blade of the cleaning device 48 or the like.

The conveyance portion 5 includes a feeding device 51, a conveying mechanism 52, a discharging device 53, and the like.

The feeding device 51 includes a feeding tray unit 511. The feeding tray unit 511 houses the sheets M. The sheets M housed in the feeding tray unit 511 are sent out one by one from the uppermost sheet, and conveyed to the image formation portion 4 by the conveying mechanism 52 provided with a plurality of conveyance rollers such as resist rollers 521. On this occasion, the tilt of the fed sheet M is corrected and moreover the conveyance timing is adjusted by a resist portion where the resist rollers 521 are provided.

In the image formation portion 4, the toner image of the photosensitive drum 43 is transferred to an image formation surface of the sheet M and the fixing step is performed in the fixing device 6. The sheet M where the image has been formed is discharged out of the apparatus to a discharge tray (not shown) or the like by the discharging device 53 including discharging rollers 531.

The fixing device 6 includes a fixing roller 61, a pressurizing roller 62, and the like. The fixing device 6 performs a fixing process for fixing the toner image transferred to the sheet M. The fixing roller 61 and the pressurizing roller 62 constitute a nip portion where the sheet M is held and conveyed.

The fixing roller 61 is disposed on a side of the image formation surface of the sheet M, and the fixing roller 61 is rotated as a driving unit such as a motor, which is not shown, is driven.

The fixing roller 61 includes, for example, an elastic layer formed of silicone rubber or the like on an outer peripheral surface of a cylindrical core metal formed of iron or the like, and incorporates a fixing heater 63 such as a halogen heater. In contact with the image formation surface of the sheet M to which the toner image has been transferred, the fixing roller 61 heats the sheet M at a predetermined fixing temperature. In other words, the fixing roller 61 heats the sheet M in contact with the image formation surface of the sheet M while rotating.

The predetermined fixing temperature is the temperature at which the heat quantity required to melt the toner can be supplied when the sheet M passes the nip portion, and is different depending on the paper type of the sheet M on which the image is to be formed.

The pressurizing roller 62 is disposed opposite to the fixing roller 61, and is pressed against the fixing roller 61 with a predetermined pressing force. That is to say, the pressurizing roller 62 and the fixing roller 61 together function as the pressing portion that applies pressure with the sheet M held therebetween.

The pressurizing roller 62 includes, for example, an elastic layer formed of silicone rubber or the like on an outer peripheral surface of a cylindrical core metal formed of iron or the like. A surface of the pressurizing roller 62 is hard relative to a surface of the fixing roller 61 and a nip portion has a shape that the pressurizing roller 62 invades the elastic layer of the surface of the fixing roller 61 when the pressurizing roller 62 is pressed against the fixing roller 61.

[2. Description of Structure of Image Formation Portion]

FIG. 2 is a schematic diagram in which the transfer belt 45 part of the image formation portion is magnified, and a control circuit diagram. In FIG. 2, the transfer belt 45 is stretched between the two conveyance rollers 46 and this is similar to that shown in FIG. 1. The transfer roller 47 is disposed opposite to the photosensitive drum 43, and has the transfer belt 45 held between the photosensitive drum 43 and a surface of the transfer roller 47 opposite to the photosensitive drum 43.

A temperature and humidity detector 451 is a temperature and humidity detection element such as a temperature sensor and a humidity sensor. The temperature and humidity detector 451 is provided near the transfer belt 45, and detects and outputs the temperature and the humidity of the transfer belt 45.

A first heater 452 is a heat generator that generates heat by supply of AC voltage. The first heater 452 is provided outside a conveyance unit UN21, and controls the humidity of the transfer belt 45 by heating the transfer belt 45 from outside the conveyance unit UN21. Note that while the main switch of the image formation apparatus 100 is OFF, the power is directly supplied to the first heater 452 from the external AC power source (commercial power source).

The second heater 453 is a heat generator that generates heat by supply of DC voltage. The second heater 453 is provided inside the conveyance unit UN21, and controls the humidity of the transfer belt 45 by heating the transfer belt 45 from inside the conveyance unit UN21. Note that while the main switch of the image formation apparatus 100 is ON, the second heater 453 is used to control the heating by the controller to be described below on the basis of the output of the temperature and humidity detector 451.

A common terminal of a relay 454 is connected to an AC power source AC21 directly supplied from an outlet, and an NC terminal (Normally Closed terminal, the terminal connected when current is not supplied to the coil of the relay 454) of the relay 454 is connected to the first heater 452. The NO terminal (Normally Open terminal, the terminal connected when current is supplied to the coil of the relay 454) of the relay 454 remains unconnected.

The controller 455 controls the entire apparatus so that the transfer belt 45 has the appropriate humidity. Control signals from the controller 455 are output to a driving unit (not shown) such as a motor that drives the second heater 453 and the coil of the relay 454 and rotates the conveyance rollers 46, and the control signals control those operations from the upper level. The controller 455 acquires the output signal from the temperature and humidity detector 451, and controls the heating of the first heater 452 and the second heater 453, or the second heater 453 so that the transfer belt 45 has the appropriate humidity on the basis of the output signal.

When the main switch of the image formation apparatus 100 is turned on, a DC power source 456 converts the AC power source AC21 supplied from the outlet into direct current and supplies the direct current to the portions of the image formation apparatus 100 including the controller 455.

A belt cleaner 457 maintains the image quality by removing foreign substances such as the toner attached on the surface of the transfer belt 45.

[3. Description of Operation for Controlling Humidity]

Figure 3:
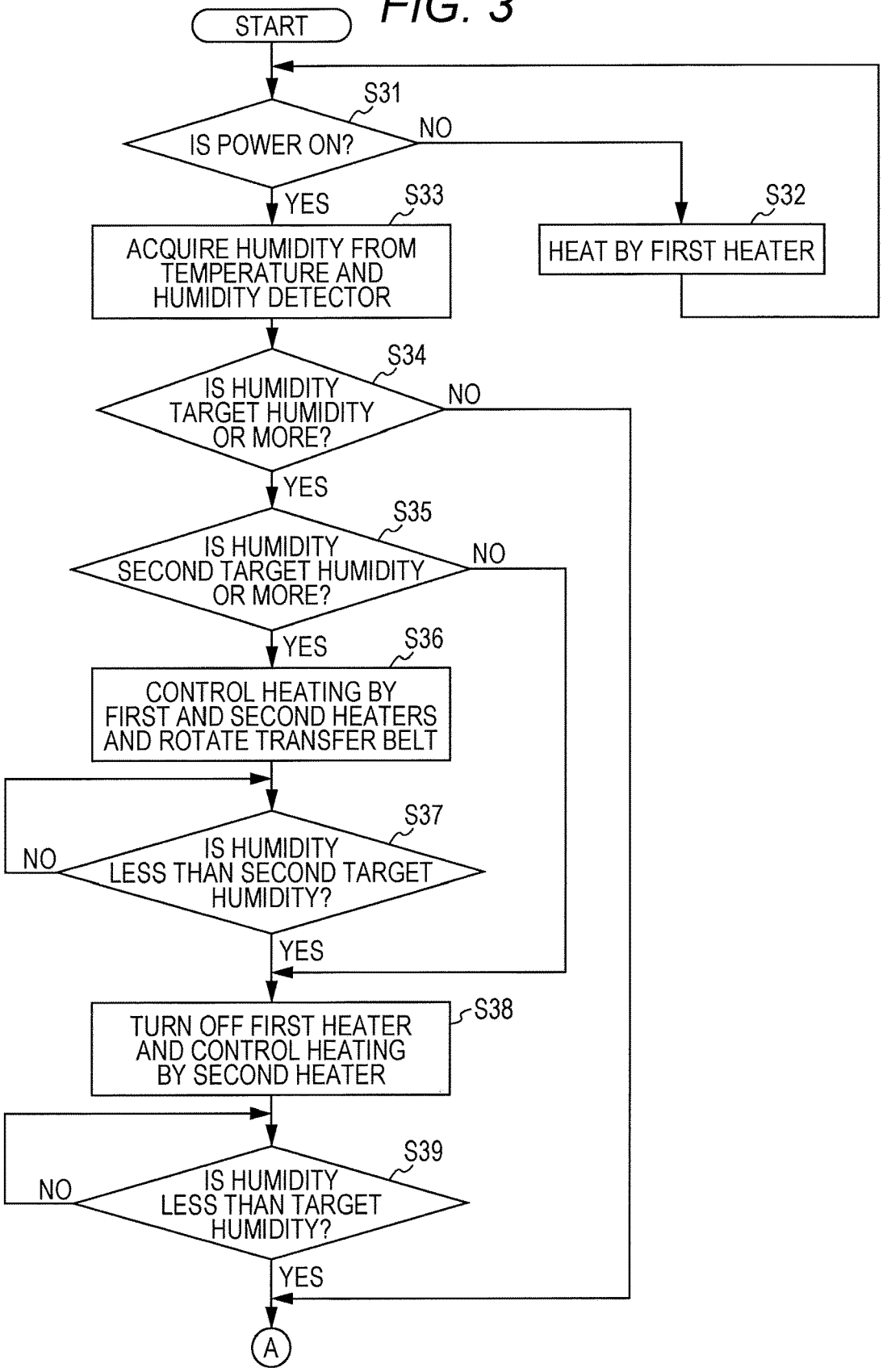
FIG. 3 is a flowchart for describing an example of an operation of the image formation apparatus.
Figure 4:
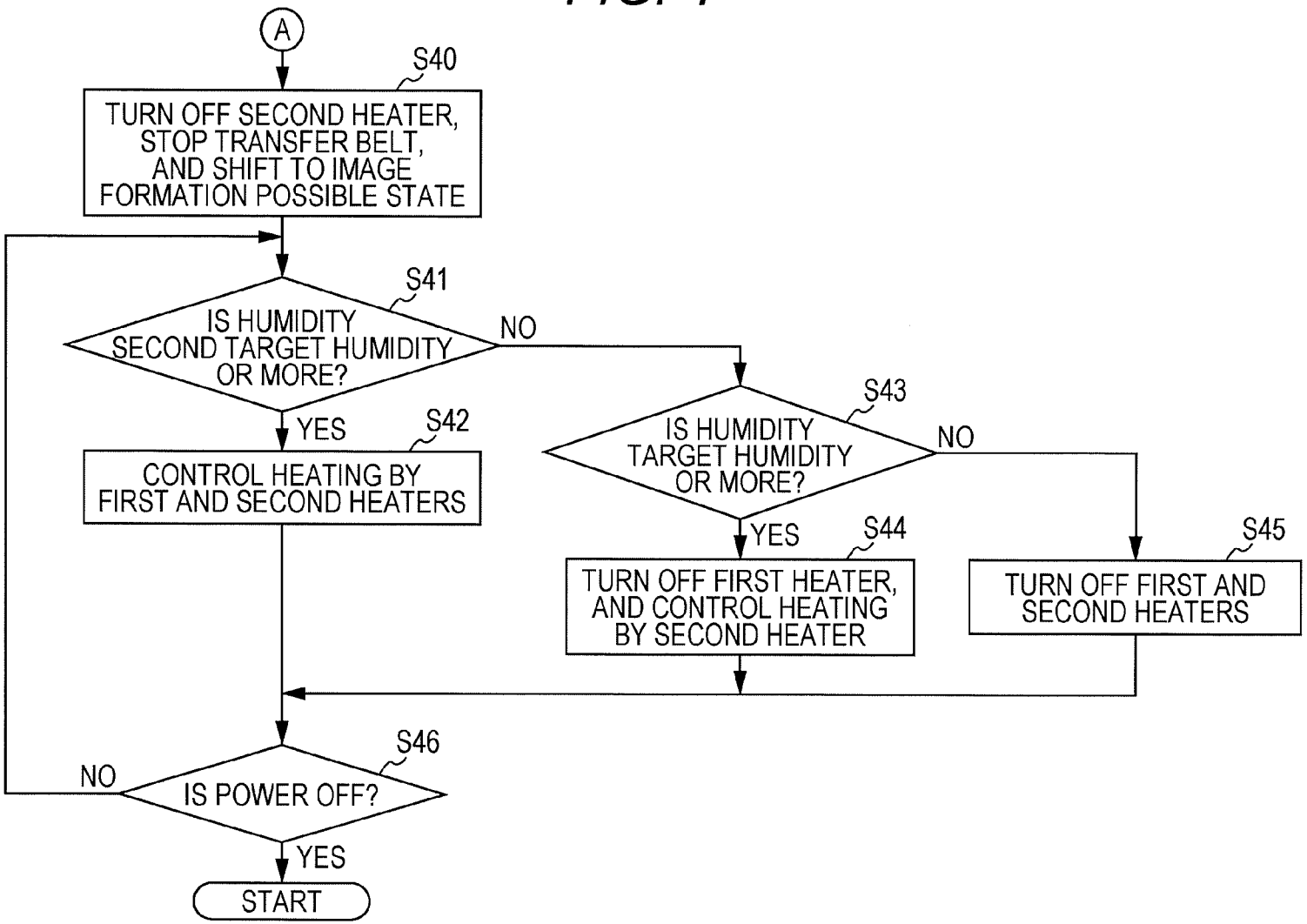
FIG. 4 is a flowchart for describing an example of an operation of the image formation apparatus.

An operation for controlling the humidity of the image formation apparatus 100 is described using the flowcharts of FIG. 3 and FIG. 4.

When the main switch of the image formation apparatus 100 is off (power is off) (No in Step S31), the DC voltage is not supplied from the DC power source 456 to the entire image formation apparatus 100 including the controller 455; therefore, the image formation apparatus 100 is not in operation.

However, since the AC power source AC21 is supplied to the first heater 452 through the NC terminal of the relay 454 regardless of whether the controller 455 and the like are in operation or not, the transfer belt 45 is always heated from outside the conveyance unit UN 21 even when the power is off (Step S32).

On the other hand, when the main switch of the image formation apparatus 100 is on (power is on) (Yes in Step S31), the DC voltage is supplied from the DC power source 456 to start the operation of the entire image formation apparatus 100 including the controller 455.

The controller 455 acquires the humidity from the temperature and humidity detector 451 (Step S33) and determines whether the humidity around the transfer belt 45 is the target humidity or more (Step S34). The target humidity is the threshold. If the humidity around the transfer belt 45 is less than the target humidity, the heating control by the heater is not performed.

If the controller 455 has determined that the humidity around the transfer belt 45 is less than the target humidity (No in Step S34), the process advances to Step S40 (to the flowchart of FIG. 4), and if the controller 455 has determined that the humidity around the transfer belt 45 is the target humidity or more (Yes in Step S34), whether the humidity around the transfer belt 45 is second target humidity or more is determined (Step S35).

Here, the second target humidity is the humidity set higher than the target humidity. If the humidity is the second target humidity or more, the heating control is performed using both the first heater 452 and the second heater 453. If the humidity is less than the second target humidity, the heating control is performed using the second heater 453 only.

If the controller 455 has determined that the humidity around the transfer belt 45 is less than the second target humidity (No in Step S35), the process advances to Step S38, and if the controller 455 has determined that the humidity around the transfer belt 45 is the second target humidity or more (Yes in Step S35), the heating control is performed using both the first heater 452 and the second heater 453 and moreover the transfer belt 45 is rotated (Step S36), and then the process advances to Step S37.

For example, the transfer belt 45 is rotated by rotating the conveyance roller 46 with the operation of the driving unit (not shown) such as a motor that rotates and drives the conveyance roller 46.

By the heating control like in Step S36, the humidity around the transfer belt 45 can be controlled to be less than the target humidity quickly; thus, the image formation can be started in a short time after the power supply.

The controller 455 determines whether the humidity around the transfer belt 45 is less than the second target humidity in Step S37, and if the controller 455 has determined that the humidity around the transfer belt 45 is the second target humidity or more (No in Step S37), the process returns to Step S37. On the other hand, if the controller 455 has determined that the humidity around the transfer belt 45 is less than the second target humidity (Yes in Step S37), the first heater 452 is turned OFF and the heating control is performed using the second heater 453 only (Step S38) and the process advances to Step S39.

For example, by the supply of current to the coil of the relay 454 by the controller 455, the connection of the common terminal of the relay 454 is switched from the NC terminal to the NO terminal; thus, the AC power source AC21 is no longer supplied to the first heater 452 and the first heater 452 can be turned OFF.

The controller 455 determines whether the humidity around the transfer belt 45 is less than the target humidity in Step S39. If the controller 455 has determined that the humidity around the transfer belt 45 is the target humidity or more (No in Step S39), the process returns to Step S39. If the controller 455 has determined that the humidity around the transfer belt 45 is less than the target humidity (Yes in Step S39), the second heater 453 is turned OFF and the rotation of the transfer belt 45 is stopped, and then the state shifts to the image formation possible state (Step S40).

That is to say, the image formation can be started by passing the time point of S40 after the power supply. The process after Step S40 shows the heating control in the case where the humidity around the transfer belt 45 has increased along with the image formation operation.

After the image formation starts, the controller 455 determines whether the humidity around the transfer belt 45 is the second target humidity or more (Step S41). If the controller 455 has determined that the humidity around the transfer belt 45 is the second target humidity or more (Yes in Step S41), the heating control is performed using both the first heater 452 and the second heater 453 (Step S42), and then the process advances to Step S46.

If the controller 455 has determined that the humidity around the transfer belt 45 is less than the second target humidity (No in Step S41), the controller 455 then determines whether the humidity around the transfer belt 45 is the target humidity or more (Step S43). If the controller 455 has determined that the humidity around the transfer belt 45 is the target humidity or more (Yes in Step S43), the first heater 452 is turned OFF and the heating control is performed using the second heater 453 only (Step S44), and then the process advances to Step S46.

If the controller 455 has determined that the humidity around the transfer belt 45 is less than the target humidity (No in Step S43), both the first heater 452 and the second heater 453 are turned OFF and the heating control is terminated (Step S45), and then the process advances to Step S46.

Finally, when the main switch of the image formation apparatus 100 is turned off (power is off) (Yes in Step S46), the controller 455 terminates the operation necessarily. If the main switch of the image formation apparatus 100 remains on (No in Step S46), the process returns to Step S41.

As described above, if the power of the image formation apparatus 100 is stopped (power OFF), the controller 455 causes the first heater 452, to which the AC power source AC21 is directly supplied from the outlet, to heat the transfer belt 45. If the power supplied to the image formation apparatus 100 remains on (power ON), the controller 455 controls the first heater 452 and the second heater 453 to heat the transfer belt 45 on the basis of the output of the temperature and humidity detector 451. Thus, the image formation can be started in a short time after the power supply.

Further, the second target humidity is set higher than the target humidity. If the humidity around the transfer belt 45 is the second target humidity or more, the heating control is performed using both the first heater 452 and the second heater 453; if the humidity around the transfer belt 45 is less than the second target humidity, the heating control is performed using the second heater 453 only. This can start the image formation in a shorter time.

In addition, the first heater 452 that operates even when the main switch of the image formation apparatus 100 is off (power is off) is provided outside the conveyance unit UN21. This can prevent the user from touching the first heater 452 accidentally.

In the description of the embodiment, the AC power source AC21 is supplied to the first heater 452 through the NC terminal of the relay 454 regardless of whether the controller 455 and the like are in operation or not; thus, the transfer belt 45 is always heated from outside the conveyance unit UN21 even when the power is off.

However, if the heat quantity of the first heater 452 is too large, for example, if the ambient temperature around the belt cleaner 457 is higher than 40° C., the toner attached to the transfer belt 45 may be hardened. Therefore, it is necessary to select the heat quantity of the first heater 452 as appropriate.

Figure 5:
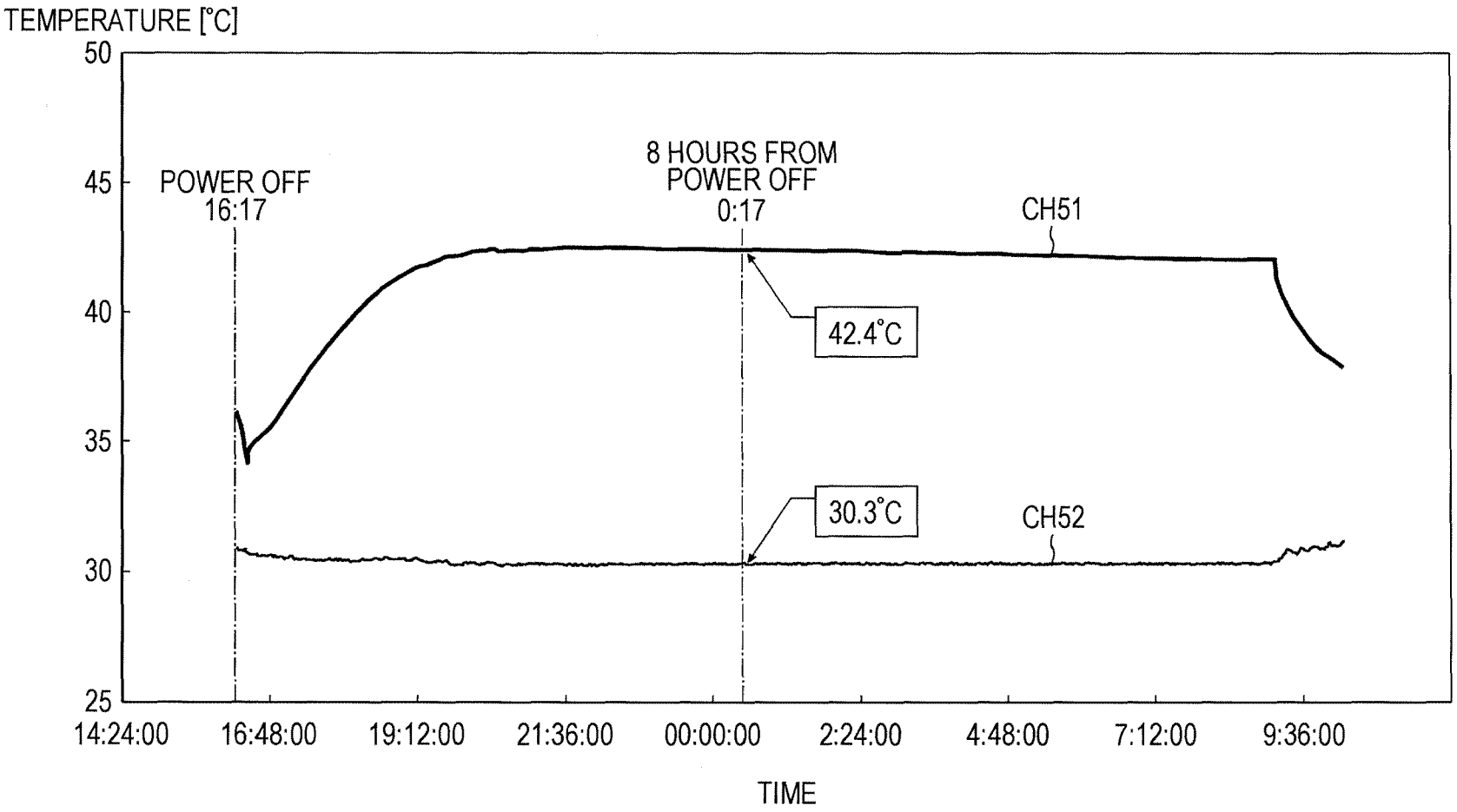
FIG. 5 is an explanatory diagram showing an example of how the temperature changes by the heating when the power is off.
Figure 6:
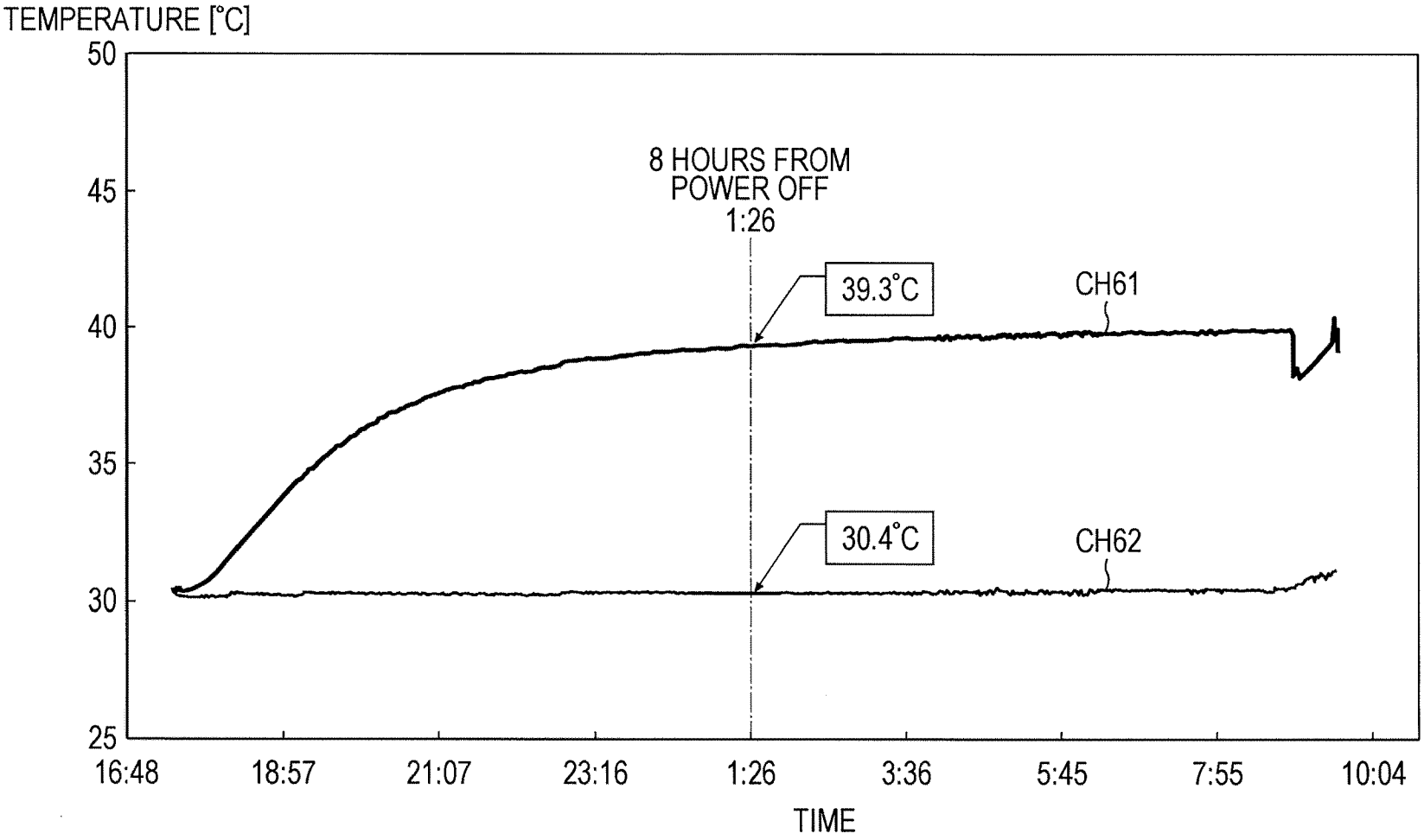
FIG. 6 is an explanatory diagram showing another example of how the temperature changes by the heating when the power is off.
Figure 7:
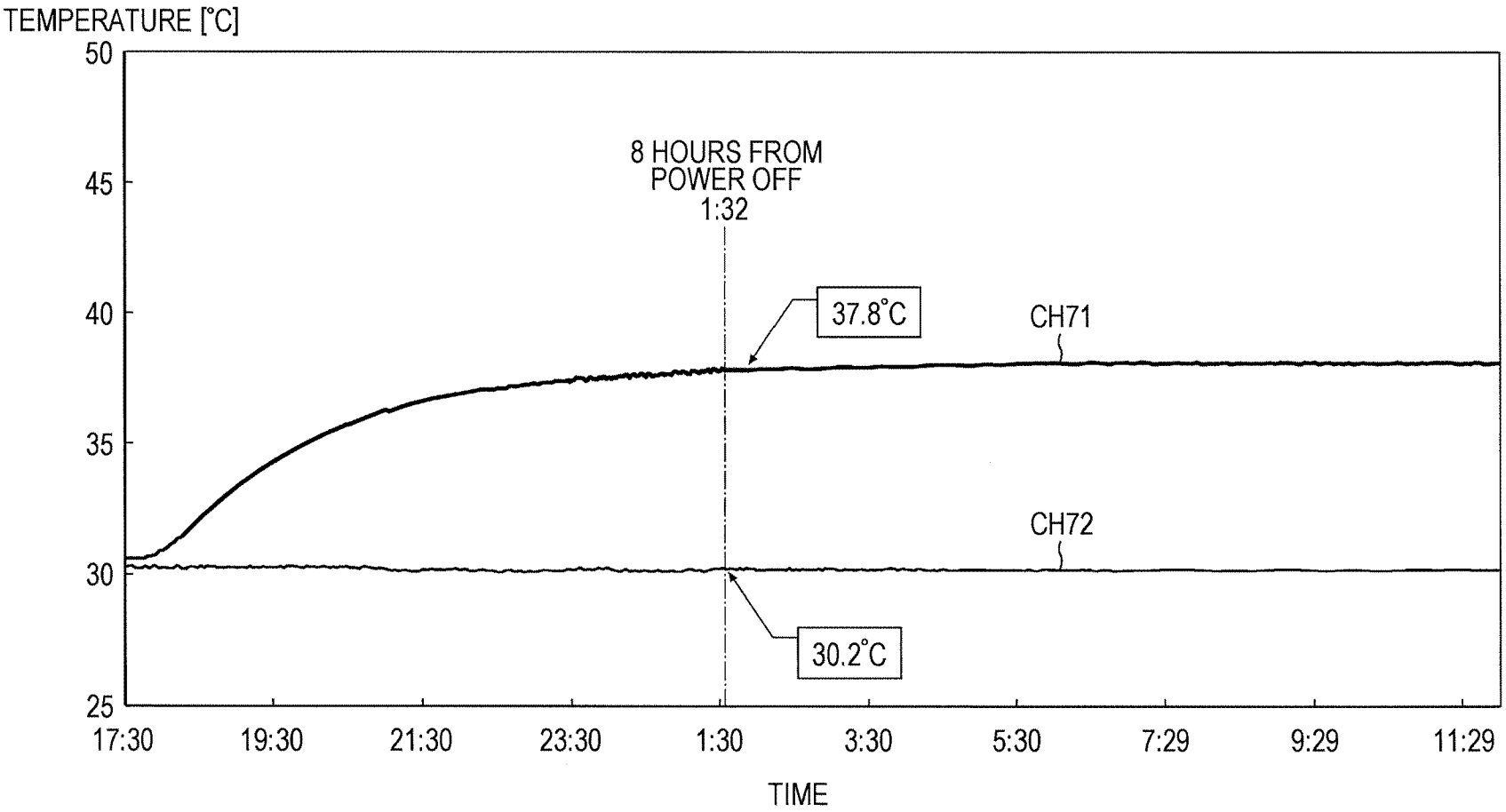
FIG. 7 is an explanatory diagram showing another example of how the temperature changes by the heating when the power is off.

For example, FIG. 5, FIG. 6, and FIG. 7 show examples of the ambient temperatures measured around the belt cleaner 457, in which the heat quantity of the first heater 452 is set to 42 W, 32 W, and 25 W. The temperatures are measured when 8 hours have passed after the power stop.

FIG. 5 shows the case in which the heat quantity of the first heater 452 is 42 W. When 8 hours have passed after the power stop, an atmospheric temperature CH52 of the image formation apparatus 100 is 30.3° C. and an ambient temperature CH51 around the belt cleaner 457 is 42.4° C., which is higher than 40° C. In this case, the toner may be hardened.

In contrast to this, FIG. 6 shows the case in which the heat quantity of the first heater 452 is 32 W. When 8 hours have passed after the power stop, an atmospheric temperature CH62 of the image formation apparatus 100 is 30.4° C. and an ambient temperature CH61 around the belt cleaner 457 is 39.3° C., which is lower than 40° C.

On the other hand, FIG. 7 shows the case in which the heat quantity of the first heater 452 is 25 W. When 8 hours have passed after the power stop, an atmospheric temperature CH72 of the image formation apparatus 100 is 30.2° C. and an ambient temperature CH71 around the belt cleaner 457 is 37.8° C., which is lower than 40° C. However, in this case, the heat quantity of the first heater 452 is lower than 32 W. Thus, in order to start the image formation in a shorter time, the heat quantity of the first heater 452 is desirably about 32 W.

In the description of the embodiment, the second heater 453 is the heat generator that generates heat by the supply of the DC voltage but may alternatively be a heat generator that generates heat by the supply of the AC voltage.

In the description of the embodiment, the controller 455 performs the heating control on the basis of the humidity around the transfer belt 45 but may alternatively perform the heating control on the basis of the humidity of an arbitrary position inside the image formation apparatus 100.

In the description of the embodiment, the controller 455 terminates the heating control when the humidity around the transfer belt 45 becomes lower than the target temperature but may alternatively terminate the heating control when the humidity around the transfer belt 45 becomes lower than the target humidity and moreover a predetermined time has passed.

That is to say, even though the humidity around the transfer belt 45 becomes lower than the target humidity temporarily, the humidity around the transfer belt 45 is not necessarily stable. Thus, the heating control is terminated after a predetermined time has passed (after the humidity becomes stable). This can prevent the adverse influence that the ON/OFF of the heating control is frequently switched (for example, the occurrence of flicker).

In the description of the embodiment, when the humidity around the transfer belt 45 is the second target humidity or more, the controller 455 performs the heating control using both the first heater 452 and the second heater 453 and moreover rotates the transfer belt 45, but may alternatively control the rotation speed of the transfer belt 45 on the basis of the output of the temperature and humidity detector 451.

In this case, the rotation speed of the transfer belt 45 is changed in accordance with the humidity around the transfer belt 45; thus, the humidity of the transfer belt 45 can be controlled more efficiently.

In the description of the embodiment, the image formation apparatus 100 that forms an image in single color has been shown. However, the image formation apparatus may alternatively include the image formation unit for each of Y (yellow), M (magenta), C (cyan), K (black), and the like to form a color image on the sheet M.

In the description of the embodiment, the recording medium is a sheet but is not limited to the sheet. The recording medium may be any sheet-shaped medium on which the toner image can be formed and fixed, and corresponds to, for example, a nonwoven fabric, a plastic film, a leather, or the like.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image formation apparatus having a recording medium held between a photosensitive drum and a transfer belt and transferring a toner image from the photosensitive drum to the recording medium, the apparatus comprising:

a first heating unit to which power is supplied directly from outside when power of the apparatus is off;

a second heating unit used in heating control when the power of the apparatus is on;

a humidity detection unit configured to detect humidity inside the apparatus; and a control unit configured to, when the power of the apparatus is on, heat the transfer belt by controlling the first heating unit and the second heating unit on the basis of output of the humidity detection unit, wherein the transfer belt is heated by the first heating unit when the power of the apparatus is off.

2. The image formation apparatus according to claim 1, wherein the transfer belt is housed in a conveyance unit, and the first heating unit is provided outside the conveyance unit and the second heating unit is provided inside the conveyance unit.

3. The image formation apparatus according to claim 1, wherein the control unit terminates heating of the transfer belt when the humidity in the apparatus becomes lower than target humidity.

4. The image formation apparatus according to claim 3, wherein the control unit terminates heating of the transfer belt when the humidity in the apparatus becomes lower than the target humidity and a predetermined time has passed after the humidity in the apparatus becomes lower than the target humidity.

5. The image formation apparatus according to claim 3, wherein the control unit heats the transfer belt by controlling the first heating unit and the second heating unit when the humidity in the apparatus is higher than a second target humidity, which is higher than the target humidity, and the control unit heats the transfer belt by controlling the second heating unit when the humidity in the apparatus is lower than the second target humidity and higher than the target humidity.

6. The image formation apparatus according to claim 1, further comprising a driving unit configured to rotate the transfer belt, wherein the control unit controls the driving unit to rotate the transfer belt when the transfer belt is heated.

7. The image formation apparatus according to claim 1, wherein the control unit controls a rotation speed of the transfer belt on the basis of the output of the humidity detection unit.

8. The image formation apparatus according to claim 1, wherein the transfer belt is always heated by the first heating unit when the power of the apparatus is off.

9. The image formation apparatus according to claim 1, wherein the transfer belt is heated by only the first heating unit when the power of the apparatus is off.

10. The image formation apparatus according to claim 1, wherein

The second heating unit used in heating control only when the power of the apparatus is on.

11. The image formation apparatus according to claim 1, further comprising:

a connector configured to connect the image forming apparatus to a main power source;

a main switch configured to turn the image forming apparatus on and off; and a first heater switch connected to the connector such that power to the first heater is automatically turned on when the main switch turns the image forming apparatus off.

12. The image formation apparatus according to claim 1, wherein the control unit is not in operation when the power of the apparatus is off.

* * * * *